United States Patent [19]

Simon

[11] 4,139,919

[45] Feb. 20, 1979

[54] INTERNAL SUPPORT STRUCTURE FOR A MATTRESS

[75] Inventor: LeRoy J. Simon, Chicago, Ill.

[73] Assignee: Serta, Inc., Rosemont, Ill.

[21] Appl. No.: 858,416

[22] Filed: Dec. 7, 1977

[51] Int. Cl.[2] ..... A47C 23/02

[52] U.S. Cl. ..... 5/267; 5/261

[58] Field of Search ..... 5/259–261, 5/267, 276, 351

[56] References Cited

U.S. PATENT DOCUMENTS

| | | | |
|---|---|---|---|
| 3,242,505 | 3/1966 | Tyhanic | 5/267 |
| 3,327,331 | 1/1967 | Simon | 5/267 |
| 3,774,248 | 11/1973 | Huras et al. | 5/267 |

*Primary Examiner*—Casmir A. Nunberg

*Attorney, Agent, or Firm*—Neuman, Williams, Anderson & Olson

[57] ABSTRACT

An internal support structure for a mattress which has a plurality of springs oriented in matrix fashion into a plurality of rows and columns, at least one outer border wire extending around the periphery of the matrix and secured to the springs located at the border or terminal rows and columns of the matrix, layers of padding or cushioning material and a fabric cover. The internal support unit comprises an inner border wire structure which is connected to the outer border wire of the mattress and to at least some of said springs. The inner border wire includes four separate wire band sections which overlap one another in a grid pattern and form a closed inner border loop. The ends of each band section are connected to the outer border wire. The inner border wire and outer border wire are concentric and located in the same horizontal plane. The band sections of the inner border wire which are parallel to the longitudinal axis of the mattress are secured at spaced locations to at least some of the springs which the sections overlay. The band sections of the inner border wire which are transverse to the longitudinal axis of the mattress are not attached to the springs which the sections overlay. The overlapping ends of each longitudinal and transverse band section are connected to the outer border wire and form a V-shaped support at each corner of the mattress. The internal support unit also comprises a plurality of spaced apart supplemental bands which join together the two transverse band sections of the inner border wire and form the central portion of the support structure for the mattress.

4 Claims, 2 Drawing Figures

INTERNAL SUPPORT STRUCTURE FOR A MATTRESS

BACKGROUND OF THE INVENTION

1. Field of the Invention

This invention relates to an internal support structure for an innerspring mattress or similar product. Innerspring mattresses comprise a plurality of coil springs placed in a plurality of rows and columns to form a generally rectangular unit. A top border wire extends around the periphery of the rectangular coil spring unit in the top plane formed by the springs and a bottom border wire similarly extends around the periphery in the bottom plane formed by the springs. The border rows and columns of coil springs are connected to the border wires. All of the coil springs are interconnected with one another. To provide additional reinforcement an internal support unit is located in at least the top plane and is secured to at least some of the coil springs. A second internal support unit is usually symmetrically located in the bottom plane. Once the individual coils have been secured together and the support units connected, the top and bottom planes formed by the springs are covered with padding or cushioning layers and the cushioned spring unit is enclosed within a fabric cover to provide a finished innerspring mattress.

An innerspring mattress unit should provide uniform weight distribution and support for the individual reclining on the mattress. While the degree of firmness is a matter of choice, an innerspring mattress unit should be resilient in the vertical direction and exhibit a minimum distortion in the horizontal direction.

2. Prior Art

Innerspring mattress units in use today frequently have an internal support structure which is positioned at different locations within the mattress. One type of edge supporting device is shown in U.S. Pat. No. 3,327,331, issued to M. Simon on June 27, 1967, entitled "Spring Unit Construction". The reinforcing structure disclosed in this patent is directed primarily to the edge and corner areas of the mattress. There is no supplemental or additional support for the central portion of the mattresses. This type of structure tends to overcompensate at the edge and corner areas resulting in a perceptible imbalance in resilience for the overall mattress.

Another well-known supplementary support structure is disclosed in U.S. Pat. No. 3,242,505, issued to S. Tyhanic on Mar. 29, 1966, entitled "Spring Unit". The central support structure disclosed in the Tyhanic patent includes an inner border wire concentric and coplanar with the standard peripheral border wire. The inner border wire is not directly connected to the outer border wire but is rather free floating. The transverse portions of the inner border wire are connected by several longitudinal bands which are connected by rings or the like to the coil spring which they overlay. While providing some edge and corner support due to the proximity of the inner border wire to the edge of the mattress unit, the Tyhanic patent is primarily directed to a central or middle mattress support structure.

Numerous practical problems occur in the use of these and other known mattress support units. One problem particularly prevalent in the structure disclosed in U.S. Pat. No. 3,242,505 involves the surface layer of padding or foam. The top and bottom surfaces of the coil springs in the mattress tend to move longitudinally relative to the support structure. This movement of the surface loops of the coil springs relative to the support structure causes abrading of the padding or foam layer overlaying the central support structure. The constant abrasion causes the padding layer to force itself between the individual coil springs thereby causing holes in the padding layer in the plane of the top or bottom of the mattress. These holes or gaps in the padding layer make the mattress surface irregular and both uncomfortable and unsightly to the user.

Another problem experienced in mattress support units is the lack of uniform resilience at both the center and the corner areas of the mattress. This problem is accentuated by the user sitting at the corner of the mattress thereby placing an unusual localized force over a small area. Another cause of stress for the corner portions of the mattress is the use of fitted sheets. In order to dress the mattress with a fitted sheet the corner of the mattress must be bowed out of its normal planar position. This abnormal bowing of the corner portion of the mattress results in weakening of the mattress corner or permanent distortion of this area. To correct the problem of non-uniform resilience due to the unusual wear at the corner areas of the mattress localized edge and corner supplementary support units such as described in U.S. Pat. No. 3,327,331 were developed. However, these localized support units result in overcompensation for the corner areas of the mattress. Over a period of time the central mattress area softens or loses resilience while the independently reinforced corner and side areas even with the unusual wear do not correspondingly lose a proportional degree of resilience. This disproportionate wearing results in a "tub" effect wherein the corners and sides are rigid in comparison to the central portion of the mattress.

SUMMARY OF THE INVENTION

The invention is an improved internal support structure for a mattress. The mattress comprises a plurality of springs arranged into several rows and columns, outer border wires connected to the coils in each peripheral row and column in the top and bottom planes formed by the coil springs, at least one uniform support structure in either the top or bottom plane, padding or cushioning layers and a fabric cover. In the preferred embodiment, two uniform support structures are used, the first coplanar with the top outer border wire and the second coplanar with the bottom outer border wire. The two support structures are mirror images and therefore for convenience only the upper support structure is described. It should be apparent to one of ordinary skill in the art that a single support unit in either the top or bottom plane could be used with a significant non-proportional decrease in the uniform resilience and a reduction of the other advantages of the two support system. Also, if a single support structure is used, the plane of the mattress with the support structure is dedicated as the top or suggested reclining surface while in the dual support structure the mattress unit is completely reversible.

In the preferred embodiment, the internal support structure comprises an inner border wire having four independent band portions which overlap one another to form an inner border loop. The inner border loop is generally rectangular and coplanar with the outer border wire of the mattress. The overlapping ends of each band portion are connected to the outer border wire thereby forming a V-shaped reinforcing unit at each corner of the mattress and which is integral with the inner border loop. The two band portions parallel to the longitudinal axis of the mattress are secured at spaced locations along their lengths to at least some of the coil springs which the sections overlay. The two band portions transverse to the longitudinal axis are not connected to the coil springs which the transverse band sections overlay. The internal support structure also comprises a plurality of spaced apart, flat connecting or supplemental wires which join together the two transverse band portions of the inner border wire. The connecting wires are secured to at least one of the coil springs which they overlay. Thus, the internal support structure has a central reinforcing section and four integral corner bracing sections. The support structure operates as a unit to provide uniform distribution of a loading force regardless of the point location of the force. Furthermore, a uniform resiliency is assured since overcompensation of high stress areas is eliminated.

An object of this invention is to provide an internal mattress support structure which uniformly distributes a loading force over a large surface area.

Another object is to provide an internal mattress support structure directly connected to the mattress unit to avoid either independent lateral or longitudinal movement of the support unit relative to the surface loops of the coil springs, thereby reducing the compacting of the padding or foam layer.

Another object is to provide an internal mattress support structure which has positive corner support members as an integral portion of an inner border loop spaced from the standard outer border wire of the mattress and directly connected therewith at the corners.

Still another object is to provide a support structure which combines a central support area having a plurality of flat bands connected to an inner border wire which is coplanar with the standard outer border wire of the mattress and a corner support structure integral with the inner border wire and directly connected with the outer border wire to improve weight distribution of a load and improve overall uniform resilience.

BRIEF DESCRIPTION OF THE DRAWINGS

Further and additional objectives will appear from the following detailed description of the preferred embodiment read in conjunction with the accompanying drawings, wherein.

DETAILED DESCRIPTION

Figure 1:
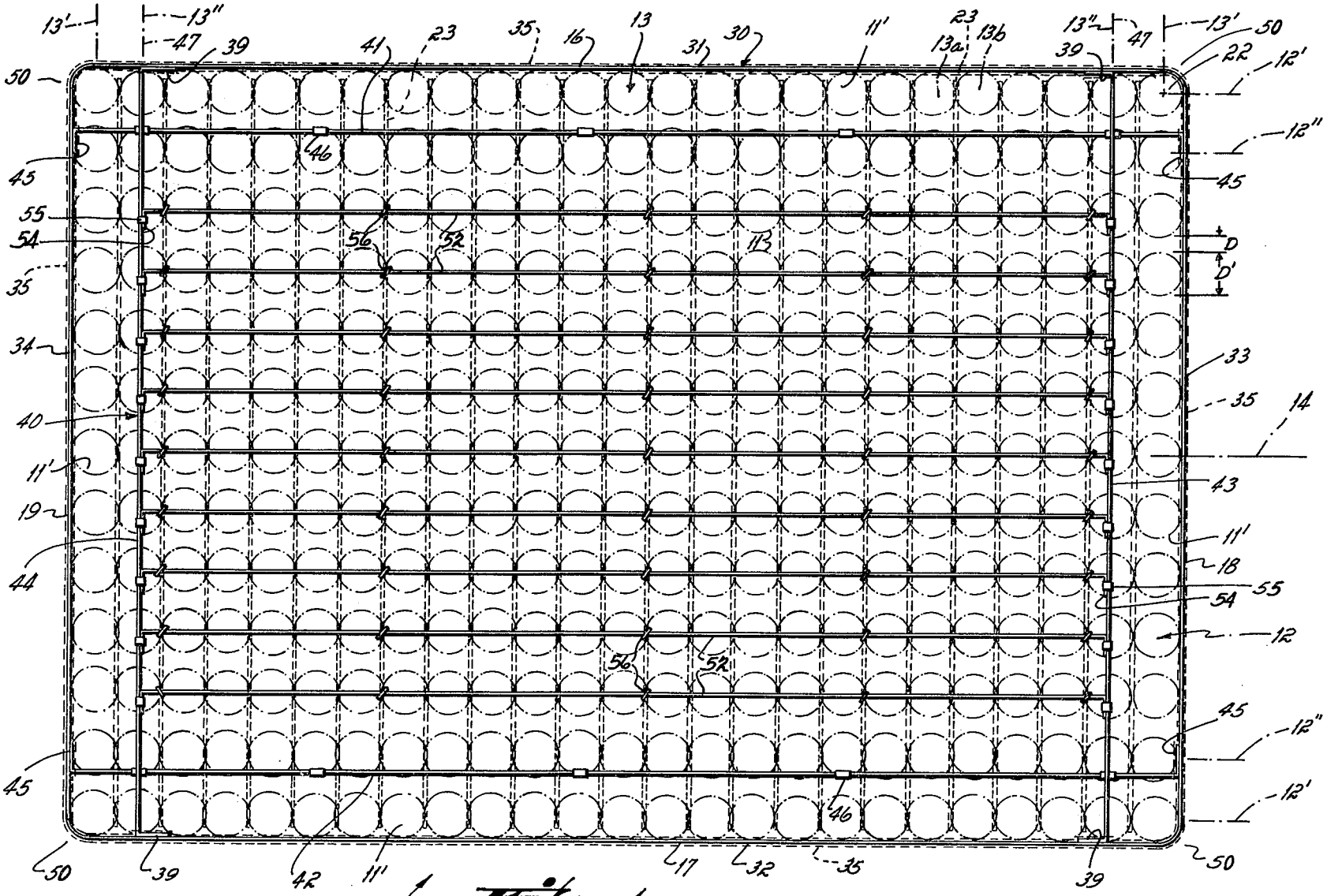
FIG. 1 is a top view illustrating the improved internal uniform support unit for use in an innerspring mattress in accord with the principles of this invention.
Figure 2:
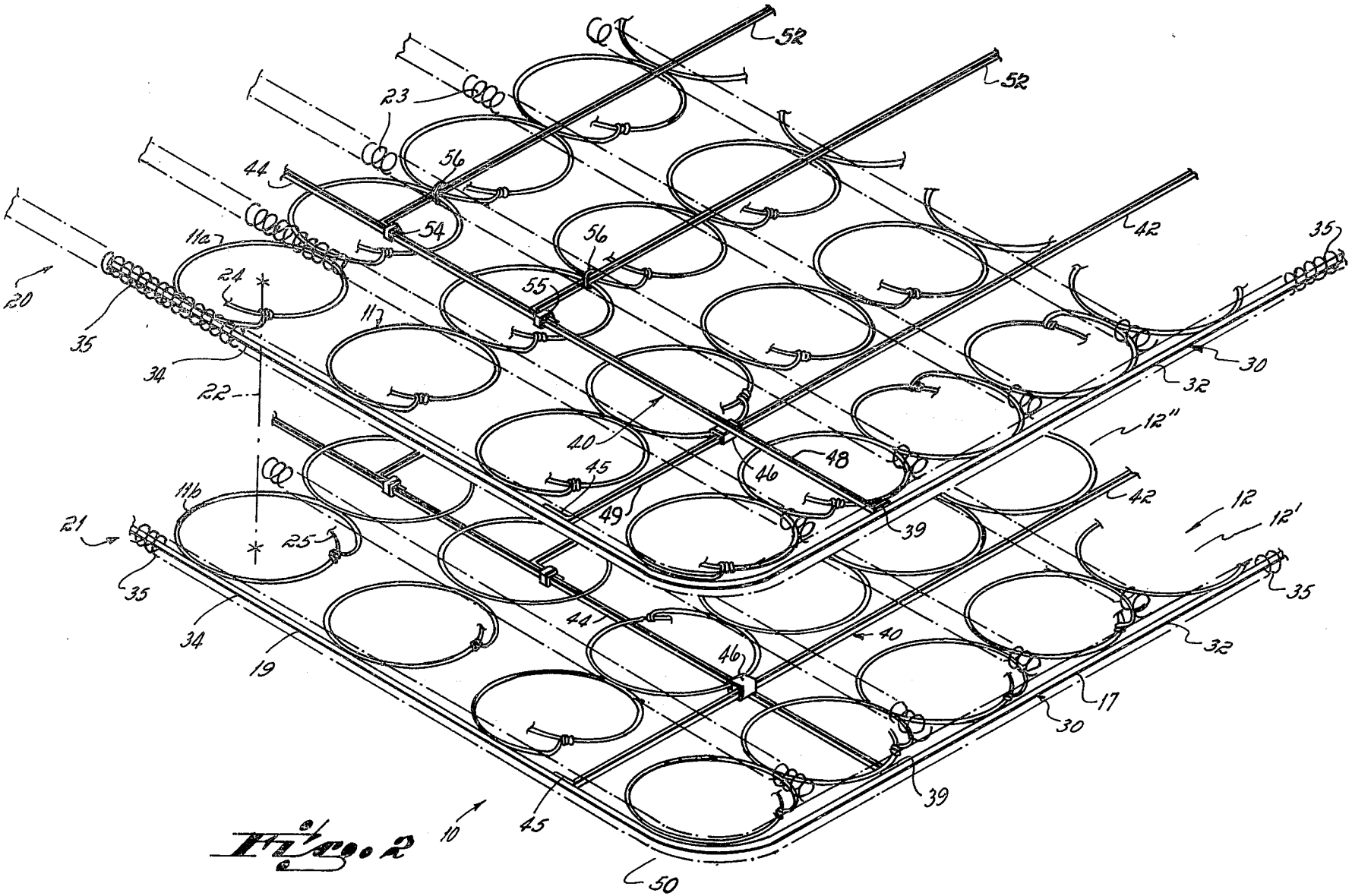
FIG. 2 is a perspective view illustrating one corner of the support unit shown in FIG. 1.

The improved internal support unit of this invention is particularly configured and adapted to be used in an innerspring mattress structure. Of course, the support unit could also be used in other types of spring units which have the requirement for uniform distribution of a load. FIG. 1 shows the standard mattress unit 10 including a plurality of double cone coil springs 11 disposed in a matrix configuration of a plurality of columns 12 of springs and a plurality of rows 13 of springs. The mattress unit's columns 12 are parallel to the longitudinal axis 14 of the mattress unit 10, and the mattress unit's rows 13 are transverse to the longitudinal axis. The mattress has a generally rectangular external or outer peripheral configuration. The rectangular mattress unit 10 has side edges 16, 17, and top 18 and bottom 19 edges. As illustrated in FIG. 2, the mattress unit 10 has a top plane 20 and a bottom plane 21, the axis 22 of the double cone coil springs 11 being oriented transverse to the top and bottom planes which are parallel to one another. It should be noted that other types of springs which are well-known in the art can be used in place of the double cone coil spring.

As is illustrated in FIG. 2, each double cone coil spring 11 includes a top loop **11*a* in the top plane 20 of the mattress unit 10, and a bottom loop 11*b* in the bottom plane 21 of the mattress unit. Only the top 11*a* and bottom 11*b* loops of each coil spring 11 have been shown for purposes of clarity in FIG. 2. Furthermore, the top loop is shown as ended at 24 and the bottom loop is shown as ended at 25, but as is well-known in the art, the ends 24, 25 are interconnected by means of a suitable spring wire spiral to establish double cone springs. In the preferred embodiment shown in FIG. 1, the columns 12 of double cone coil springs 11 are spaced one from another a distance D less than the diameter D' of the coil springs 11. The diameter of all coil springs is equal. In the preferred embodiment, the rows 13** of coil springs are juxtaposed one to the other. However, it should be noted that other types and configurations of springs, well-known in the art, can be used.

The adjacent rows 13 of coil springs 11 are held in operational relation with one another by means of a fastener in the form of a spiral wire 23. The spiral wire or lacing helix 23 extends from one side edge 16 of the spring unit 10 to the other side edge 17. As shown in FIG. 1, the spiral wire 23 is interposed between each pair **13*a*, 13*b* of adjacent rows 13 to interconnect the adjacent spring rows. Thereby all adjacent rows of the coil springs are interconnected. Although spiral wires 23** have been shown as the fastener, it is apparent to those ordinarily skilled in the art that so-called hog rings, or split rings, or other types of fasteners may be used for the same purpose.

An external border wire 30 is provided in both the top 20 and bottom 21 planes of the mattress unit 10. Each border wire 30 defines a closed outer border loop which extends around the external periphery of the mattress unit 10. The outer border wires 30 comprise side sections 31, 32, and top 33 and bottom 34 sections. In the preferred embodiment four sections 31–34 of outer border wires 30 are an integral or one-piece structure. The border wire 30, in both the top 20 and bottom 21 planes, is connected with those coil springs 11' positioned around the exterior edges 16–19 or periphery of the mattress unit 10. The border wires 30 are connected with the edge coil springs 11' by a spiral wire 35. The spiral wire or lacing helix 35 is generally similar to the spiral wires 23 used to interconnect adjacent rows **13*a*, 13*b* of coil springs 11 as previously explained. In the preferred embodiment, the external or outer border wire 30 is made of a heavier gauge wire than the coil spring 11 and the coil spring 11 wire is made of a heavier gauge wire than the spiral wire or lacing helix 35. The border wires 30 cooperate with the fastener spiral wires 23 and 35 in both the top 20 and bottom 21 planes of the mattress unit 10** to provide an integrating or interconnecting spring structure.

In the preferred embodiment an inner border wire structure 40 is provided in both the top 20 and bottom 21 planes of the mattress unit 10, see FIG. 2. It should be apparent to those of ordinary skill in the art that a single inner border wire could be provided in one plane only. For the sake of simplicity of description only one of the inner border bands or wires is described since in the preferred embodiment the two inner border wires are mirror images. The inner border wire 40 comprises separate band portions 41, 42, 43, and 44 and defines a closed inner border loop that is concentric with the outer border loop. Each inner border band portion 41–44 is connected directly with the outer border wire 30. The inner border wire 40 and outer border wire 30 are directly connected or tied together. The inner border band sections 41 and 42 are disposed parallel one to another, parallel to the longitudinal axis 14 of the mattress unit 10, and parallel to the side edges 16, and 17 of the mattress unit. In the preferred embodiment, the inner border bands 41 and 42 are spaced inwardly one column 12' of coil springs 11 from the side edges 16 and 17 of the mattress unit. As is shown in FIG. 1, each inner border section 41 and 42 is positioned to cooperate with that column 12" of springs 11 adjacent to the related side edge column 12' of springs.

The inner border band sections 41 and 42 overlay the outermost edge portion of the columns 12". Each end of the inner border band sections 41 and 42 has a dog leg 45 formed integral therewith. The opposite dog legs 45 of each inner border band section 41 and 42 are juxtaposed over the top 33 and bottom 34 edge sections of the outer border wire 30. The length of the inner border sections 41 and 42 is substantially the same as the length of the analogous side edge sections 31, 32 of the outer border wire 30. Thus, each of the inner border sections 41 and 42 is directly connected to the top 33 and bottom 34 edge sections of the outer border wire 30 by the same helical lacing wire 35 that connects the top 33 and bottom 34 outer border sections to the top and bottom rows 13' of coil springs 11. Furthermore, each of the inner border sections 41 and 42 is connected at spaced locations along its length to at least two coil springs 11 in that coil spring column 12" adjacent the related side edge column 12'. In the preferred embodiment in FIG. 1, five such connections are shown. These connections between each of the inner border sections 41 and 42 and the coil springs 11 are provided by prong clip-type fasteners 46 commonly known in the prior art and connect the inner border sections 41 and 42 to the coil springs in both the top 20 and bottom 21 planes of the mattress unit.

The inner border sections 43 and 44 are also directly connected with the outer border wire 30 in both the top 20 and bottom 21 planes. The inner border sections 43 and 44 are of a length substantially equal to the length of the adjacent top 33 and bottom 34 outer border section. Furthermore, the inner border sections 43 and 44 have a dog leg 39 at each end thereof juxtaposed to the related outer border side section 31 or 32. Thus, the inner border sections 43 and 44 are directly connected through the integral dog legs 39 with the outer border wire 30 by the same spiral or helical lacing wire 35 as is used to interconnect the outer border side sections 31 and 32 to the outer spring columns 12' of the mattress unit 10 in both the top and bottom planes. The inner border sections 43 and 44 spaced from the adjacent related outer border section 33 or 34 by a distance approximately equal to one and one-half times the diameter of the coil springs 11. Each inner border section 43 and 44 overlays and is coaxial with the axis 47 of that coil spring row 13" which is immediately adjacent to the top and bottom coil spring rows 13'. The inner border sections 43 and 44 are not directly connected at any location along its length to the coil springs 11 which they overlay.

As shown in FIG. 2, the transverse band section 44 overlays the longitudinal band section 42. The end portion 48 of transverse section 44 beyond the point of crossover is connected to the outer border portion 32. The end portion 49 of longitudinal section 42 beyond the point of crossover is connected to outer border section 34. The end portions 48 and 49 together form a V-shaped reinforcement for the corner 50 of the mattress. Since the end portions 48 and 49 are integral with the inner border wire structure 40 a uniform support structure is provided. Each of the four corner reinforcement portions in both the top and bottom planes is integral with the central support portion in its respective plane so that a point source load applied at the corner is uniformly distributed over a large surface area of the mattress unit 10.

In addition to the inner border wire 40 the internal support structure in both the top 20 and the bottom 21 include a plurality of supplemental bands 52. The supplemental or joining bands 52 together with the inner border loop form a central portion of the support unit. As is illustrated in FIG. 1, the supplemental bands 52 extend between inner border section 43 and inner border section 44. In the preferred embodiment, a supplemental band 52 overlays the column 12 axis of each column of springs 11 within the inner border loop. In the preferred embodiment shown in FIG. 1, nine supplemental bands 52 parallel one to another are provided, and are directly connected at opposed ends to inner border sections 43 and 44.

The supplemental bands 52 also are provided with a dog leg 54 on each end thereof. The supplemental bands 52 are directly connected to the inner border sections 43 and 44 by clamp-type clips 55 well-known to the prior art. In the preferred embodiment, each supplemental band 52 is also connected with that column 12 of coil springs 11 which it overlays at spaced locations along its length, by so-called hog rings or split rings 56. The hog rings connect the supplemental band 52 to a pair of adjacent coil springs 11 in that column at each connection point. In the preferred embodiment illustrated in FIG. 1, five such interconnection points for each supplemental band 52 are shown. The supplemental bands 52 are of a gauge and width less than the gauge and width of the inner border bands 41–44. It is preferred that the thickness and width of the supplemental bands 52 be no greater than the thickness and width of the inner border bands 41–44.

The direct connection of the inner border band sections 41–44 with the outer border wire sections 31–34 reduces horizontal motion of the top **11*a* and bottom 11*b* coil loops of the coil springs 11 and eliminates the independent motion of the internal support structure. Thus, the abrading between those coil spring loops 11*a*, 11*b* and the support structure and the stuffing or padding (not shown) which is placed on the top and on the bottom of the spring unit is lessened. Due to the cessation of the motion, the padding is not forced between the springs 11 during the use of the mattress and the formation of holes in the padding layer is eliminated. Further, the direct connection of the inner border sections 41–44 with the outer border sections 31–34 reduces the tendency of the spring unit's corners 50 to become bowed or curved relative to the top 20 and bottom 21 planes of the spring unit 10** thereby strengthening the mattress corners over the mattress's useful life. Furthermore, since the central portion is integral with the edge portion of the overall support structure, the tendency to have a disproportionate resilience due to independent support structures is removed.

Having described the invention, what is claimed is:

1. An internal support structure for a mattress having a plurality of springs interconnected together forming a generally rectangular spring unit with a longitudinal axis and a top outer border wire extending around the periphery of said spring unit in the top plane of said unit and a bottom outer border wire extending around the periphery of said spring unit in the bottom plane of said unit and both said top and bottom outer border wires affixed to at least one of said springs, comprising:

a top inner border wire coplanar with said top outer border wire and a bottom inner border wire coplanar with said bottom outer border wire;

each of said top and bottom inner border wires comprises four independent band sections which overlay one another forming a grid like pattern, two of said independent band sections being parallel to said longitudinal axis of said spring unit and two of said independent band sections being transverse to said longitudinal axis of said spring unit;

the ends of each of said band sections of said top and bottom inner border wires are connected respectively to said top and bottom outer border wires so that the overlapping end portion of one longitudinal band and one transverse band form a V-shaped support element respectively in said top and bottom plane at each corner of said spring unit and the non-overlapping portion of said band sections form an inner border loop respectively in said top and bottom plane concentric which said top and bottom outer border wires;

said top V-shaped support structures are integral with said top inner border wire and said bottom V-shaped support structures are integral with said bottom inner border wire and provide support at each corner of said spring unit;

a top set of supplemental bands coplanar with said top inner border wire and a bottom set of supplemental bands coplanar with said bottom inner border wire and both said top and bottom set of supplemental bands are parallel to the longitudinal axis of said spring unit; and, said top set of supplemental bands connect together within said top inner border loop said independent transverse band sections of said top inner border wire and said bottom set of supplemental bands connect together within said bottom inner border loop said independent transverse band sections of said bottom inner border wire and provide support at the central portion of said spring unit.

2. An internal mattress support structure as set forth in claim 1 further comprising first means for fastening each of said top longitudinal band sections of said top inner border wire to at least one of said springs in said top plane and each of said bottom longitudinal band sections of said bottom inner border wire to at least one of said springs in said bottom plane.

3. An internal support structure as set forth in claim 2 wherein each of said top transverse band sections of said top inner border wire directly overlays a row of said springs in said top plane and each of said bottom transverse band sections of said bottom inner border wire directly overlays a row of said springs in said bottom plane.

4. An internal support structure as set forth in claim 3 wherein each of said top set of supplemental bands directly overlays a column of said springs in said top plane and each of said bottom set of supplemental bands directly overlays a column of said springs in said bottom plane and further comprising second means for fastening each of said top supplemental bands to at least one pair of said springs in said top plane and each of said bottom supplemental bands to at least one pair of said springs in said bottom plane.

* * * * *